US007868838B2

(12) United States Patent
Tai

(10) Patent No.: US 7,868,838 B2
(45) Date of Patent: Jan. 11, 2011

(54) ULTRA WIDEBAND ANTENNA

(75) Inventor: Lung-Sheng Tai, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 181 days.

(21) Appl. No.: 12/150,612

(22) Filed: Apr. 30, 2008

(65) Prior Publication Data

US 2008/0266186 A1 Oct. 30, 2008

(30) Foreign Application Priority Data

Apr. 30, 2007 (TW) ..... 96115269 A

(51) Int. Cl.
*H01Q 1/36* (2006.01)

(52) U.S. Cl. ..... 343/729; 343/767; 343/828; 343/830

(58) Field of Classification Search ..... 343/700 MS, 343/702, 846, 729, 767, 825, 826, 829, 830
See application file for complete search history.

(56) References Cited

U.S. PATENT DOCUMENTS 6,861,986 B2 3/2005 Fang et al.
7,446,717 B2 * 11/2008 Hung et al. ..... 343/702

* cited by examiner

*Primary Examiner*—Michael C Wimer
(74) *Attorney, Agent, or Firm*—Wei Te Chung; Andrew C. Cheng; Ming Chieh Chang

(57) ABSTRACT

A wideband antenna includes a ground element comprising an upper first side, a first metal sheet a short arm connecting to the first side of the grounding element and a long arm separated from the first side, a second metal sheet electrically connecting to the first metal sheet, a third metal sheet perpendicular to the second metal sheet, and a slot between the first side of the ground element and the long arm of the first metal sheet; wherein said slot, said second metal sheet and said third metal sheet work together to form an ultra wide resonant frequency.

11 Claims, 5 Drawing Sheets

1

ULTRA WIDEBAND ANTENNA

CROSS-REFERENCE TO RELATED APPLICATION

This application is related to a copending application entitled "MULTI-BAND ANTENNA", which has the assignee as the present invention.

BACKGROUND OF THE INVENTION

1. Field of the Invention

The present invention relates generally to an ultra wideband antenna, and more particularly to an ultra wideband antenna assembling in an electronic device, such as notebook.

2. Description of the Prior Art

At present, Ultra Wideband (UWB), Bluetooth and IEEE802.11/a/g are three main technologies for wireless transmitting radio frequencies used in consumer electronic devices. To be a technology used for WPAN (Wireless Personal Area Network) application, UWB is better than Bluetooth. Because UWB has ultra wider ranges of working frequency benefiting UWB with a better anti-interference ability, and lower consumption electric.

PIFA (Planar Invert-F Antenna) is a common type of antennas used in electronic devices, such as disclosed and claimed in U.S. Pat. No. 6,861,986 issued to Fang on Mar. 5, 2005. PIFA has advantages of simple-manufacturing-process, compact dimension and easy-setting. However, prior art PIFA generally works in dual-band or multi-band, but its configuration can not make it suitable for working in UWB.

Hence, a new configured PIFA is needed for working on the ultra wideband environment.

BRIEF SUMMARY OF THE INVENTION

An object of the present invention is to provide a newly configured PIFA antenna suitable for working at an ultra wideband environment so as to facilitate an interference-free, low power consumption, while high efficiency signal transmission.

In order to implement the above object and overcomes the above-identified deficiencies in the prior art, the wideband antenna comprises a ground element comprising an upper first side, a first metal sheet connected to the first side of the grounding element and a long arm separated from the first side defining a slot with respect to the first side of the ground element, a second metal sheet electrically connected to the first metal sheet, and a third metal sheet perpendicular to the first and second metal sheet; wherein said slot, said second metal sheet and said third metal sheet work together to form an ultra broad resonant frequency.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
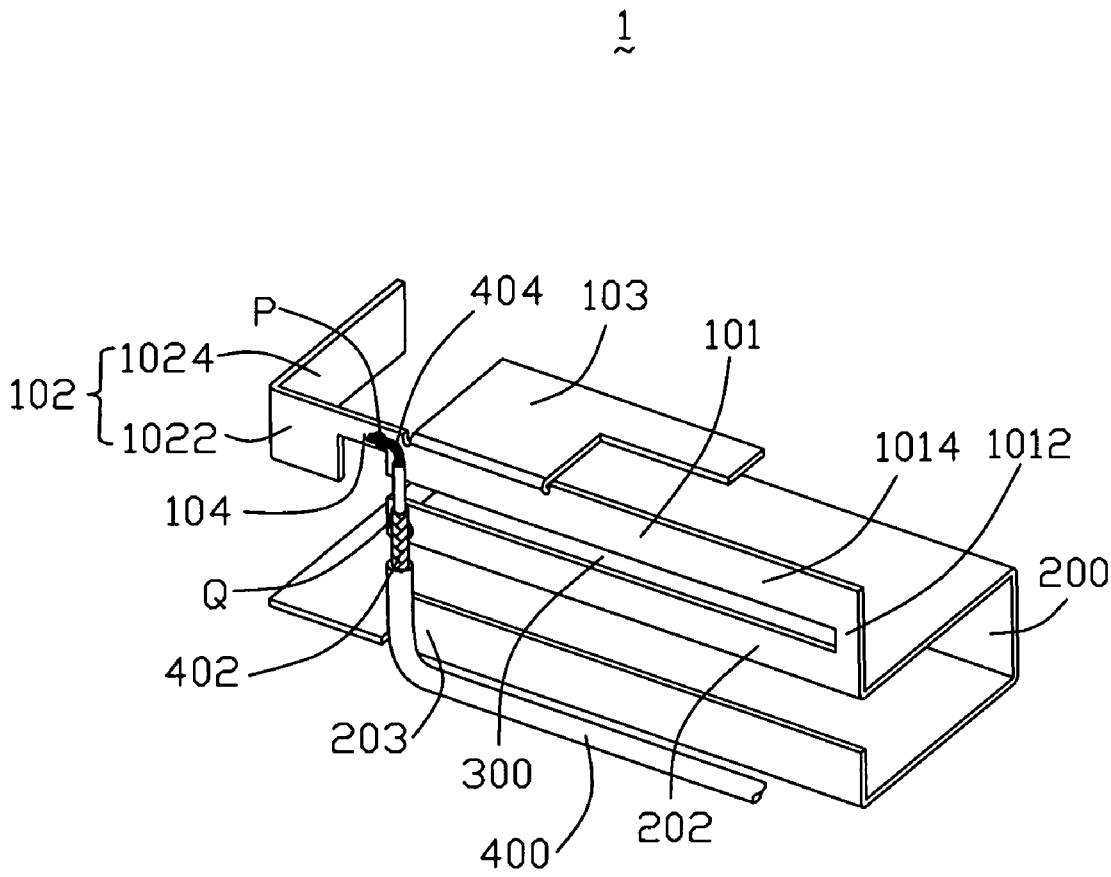
FIG. 1 is a perspective view illustrating a first embodiment of a wideband antenna in according with the present invention.
Figure 2:
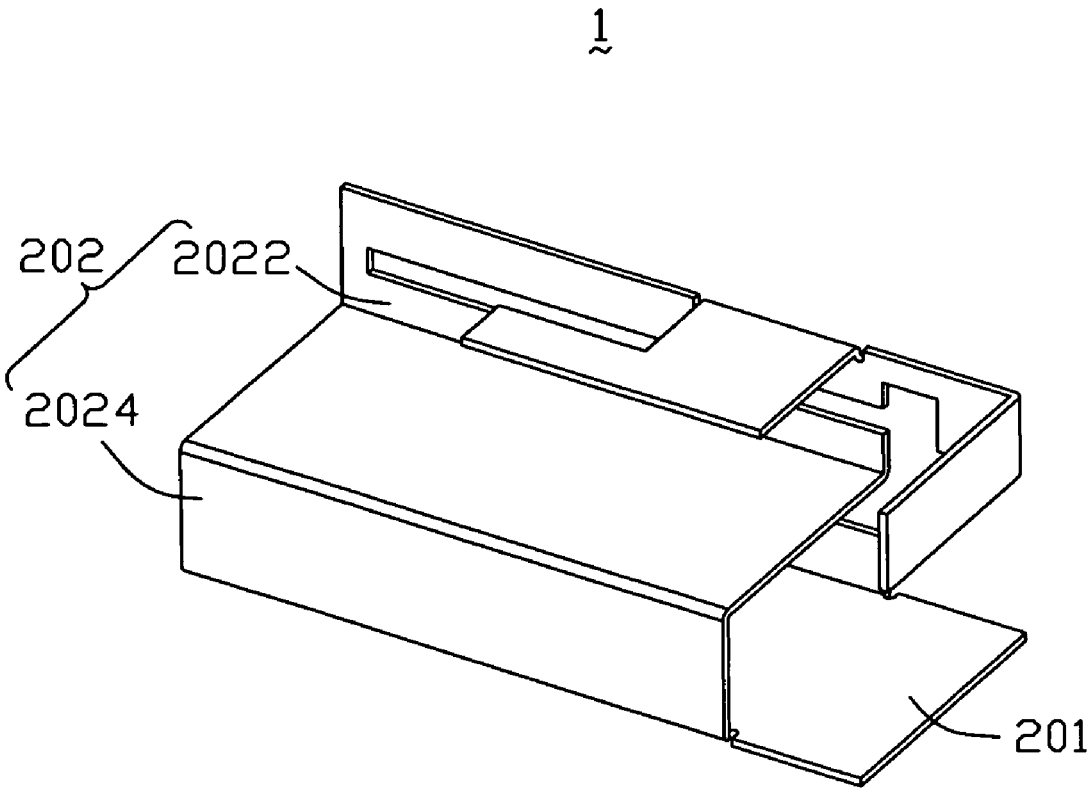
FIG. 2 is a perspective view of the FIG. 1, but viewed from a different angle.

Reference to FIGS. 1 and 2, an ultra wideband antenna 1 in accordance with a first embodiment of the present invention is shown. The ultra wideband antenna 1 comprises a ground element 200, a vertical L-shape first metal sheet 101 extending from the grounding element 200, a vertical L-shape second metal sheet 102 connecting to the first metal sheet 101 through a vertical neck 104 and a horizontal L-shape third metal sheet 103 perpendicular extending from the upper surface of the first metal sheet 101. The first metal sheet 101 has a shorter arm 1012 connecting to the grounding element 200 and a long arm 1014 connecting to the third metal sheet 103 and the conductive piece 104. The second metal sheet 102 comprises a first arm 1022 connecting to the conductive piece 104 and a second arm 1024 perpendicularly extending from the first arm 1022. The second arm 1024, the third metal sheet 103 and the grounding element 200 are on the same side of the first metal sheet 101 in vertical direction.

The grounding element 200 comprises a rectangular first patch 201, a Z-shape second patch 202 narrower than the first patch 201 and perpendicularly upwardly extending from one side of the first patch 201 and a rectangular third patch 203 narrower than the first patch 201 and perpendicularly upwardly extending from the other side of the first patch 201. The second patch 202 comprises an upper first side 2022 connected to the first metal sheet 101 and a second side 2024 perpendicularly connected to the first patch 201. The second metal patch 202 and the third metal patch 206 are at the upper side of the first metal patch 201. In other embodiment, if need be, the grounding element 200 can be changed to other shape.

The long arm 1014 of the first metal sheet 101 is separated and parallel to the first side 2022 of the second patch 202 of the grounding element 200, and a slot 300 is between the long arm 1014 and the first side 2022.

Figure 5:
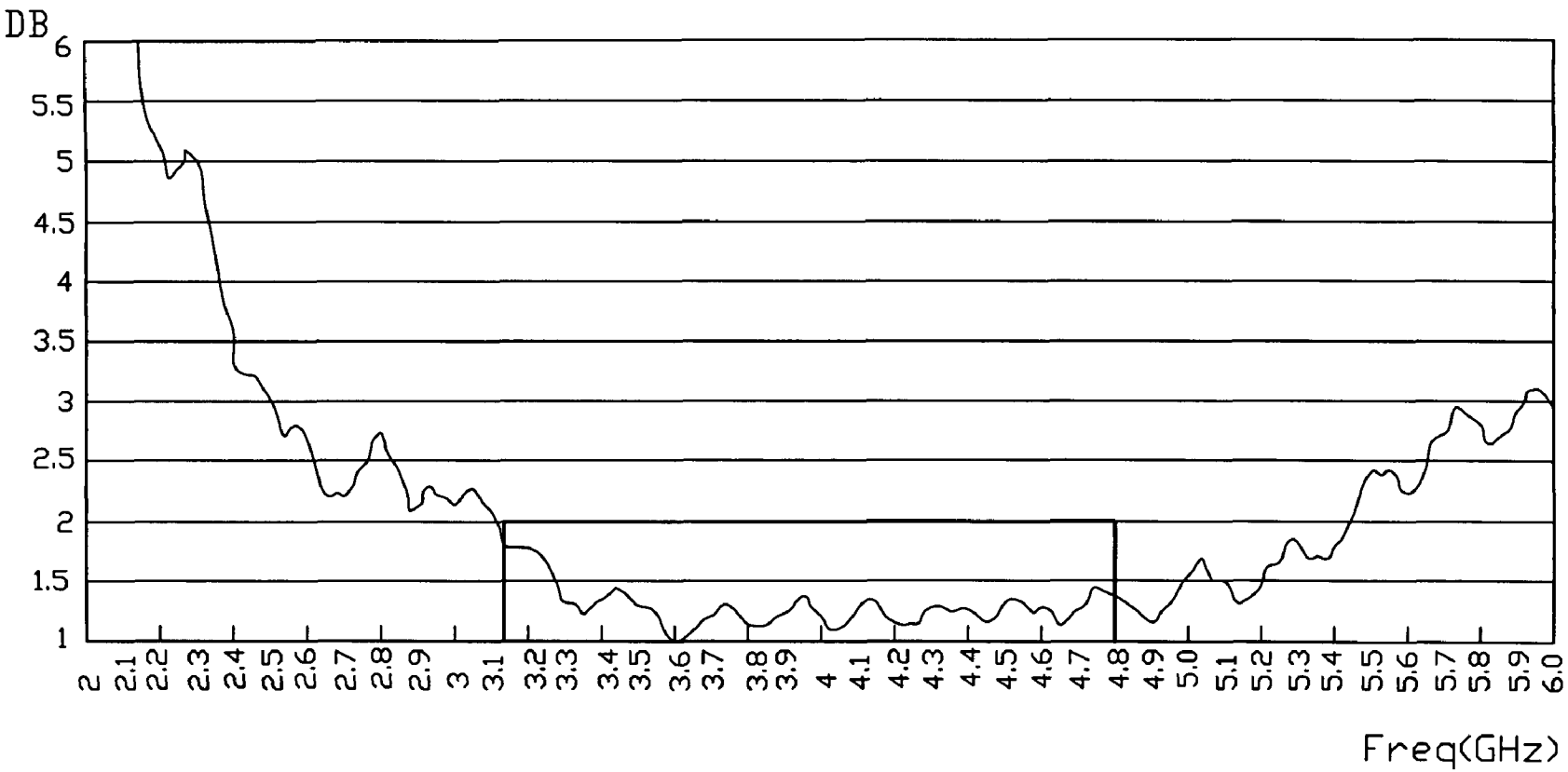
FIG. 5 is a test chart recording for the wideband antenna of FIG. 1, showing Voltage Standing Wave Ratio (VSWR).

The UWB antenna 1 further comprises a feeding line 400 which comprises an inner conductor 404 connecting to the conductive piece 104 to form a feeding point P and an outer conductor 402 connecting to the grounding element 200 to form a grounding point Q. The second metal sheet 102 is used to send and receive the first resonant frequency signals. The third metal sheet 103 work at the second resonant frequency. The slot 300 forms the third resonant frequency. The first, second and third resonant frequency are combined to form an ultra wide frequency band. Reference to FIG. 5, the UWB antenna 1 can work at an ultra wide frequency band which is from 3.15 GHz to 4.80 GHz.

Figure 3:
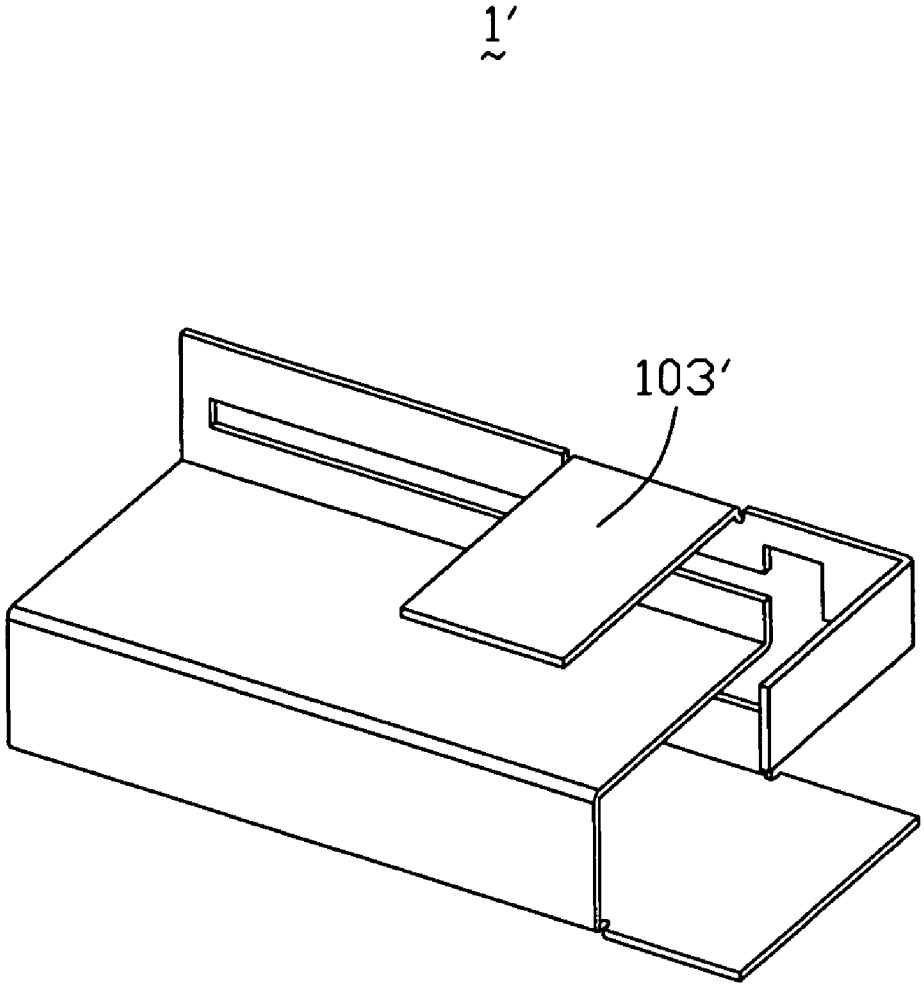
FIG. 3 is a perspective view illustrating a second embodiment of a wideband antenna in according with the present invention.
Figure 4:
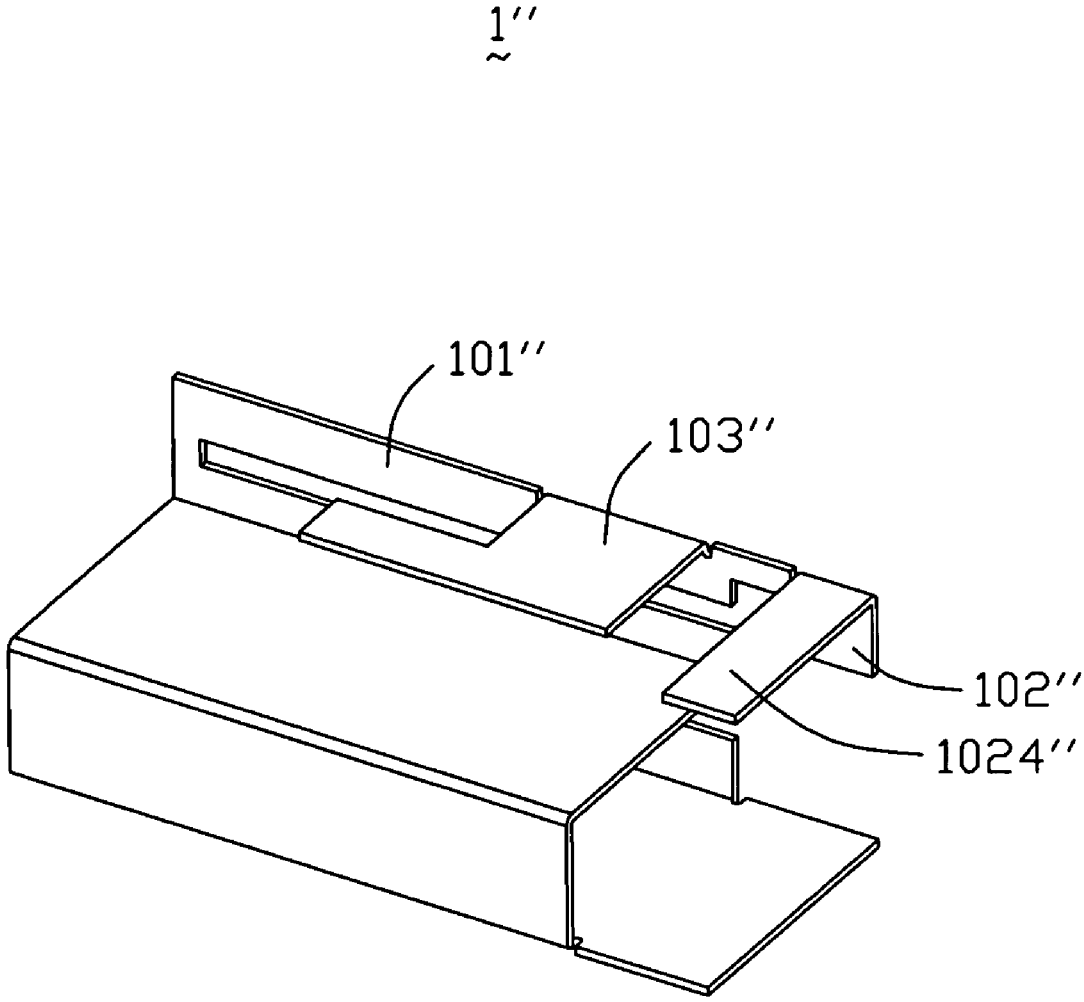
FIG. 4 is a perspective view illustrating a third embodiment of a wideband antenna in according with the present invention.

In other embodiment, the second metal sheet 102 and the third metal sheet 103 can be design to other shape. Reference to FIG. 3, an ultra wideband antenna 1' in accordance with a first embodiment of the present invention is shown. The UWB antenna 1' comprises a third metal sheet 103' different from that in the UWB antenna 1. It is rectangular that the third metal sheet 103' is. Reference to FIG. 4, an ultra wideband antenna 1" in accordance with a second embodiment of the present invention is shown. The UWB antenna 1" comprises a second metal sheet 102" different from that in the UWB antenna 1, 1'. It is parallel to the third metal sheet 103" that the second metal sheet 102" has a long arm 1024". And then in the horizontal direction, the second arm 1024" and the third metal sheet 103" are also on the same side of the first metal sheet 101".

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An ultra wideband antenna comprising:

a ground element comprising an upper first side;

a first metal sheet connected to the first side of the grounding element and a long arm separated from the first side defining a slot with respect to the first side of the ground element;

a second metal sheet electrically connected to the first metal sheet; and a third metal sheet perpendicular to the first and second metal sheet;

wherein said slot, said second metal sheet and said third metal sheet work together to form an ultra broad resonant frequency; wherein a notch is formed in a joint between the first metal sheet and the second metal sheet, and the slot defines an open end terminated around said notch, under condition that a feeder cable includes an outer cable soldered to the grounding element around said open end of said slot, and an inner cable soldered to said joint.

2. The ultra wideband antenna as claimed in claim 1, wherein the first metal sheet, the third metal sheet and the grounding element commonly define an S-like configuration in a side view, and the first metal sheet and the third metal sheet occupy an upper half of said S-like configuration.

3. The ultra wideband antenna as claimed in claim 1, wherein the grounding element defines a U-shaped cross-sectional configuration having two spaced horizontal plates, and the third metal sheet is parallel to said two spaced horizontal plates.

4. A wideband antenna comprising:

a ground element defining at least a lying U-shaped structure having an upper lying plate;

a grounding flange extending along an edge of said upper lying plate;

a first L-shaped metal strap connected to the said ground flange with a first slot extending horizontally therebetween;

a second L-shaped metal strap connected to a distal end of said first metal strap via a neck section; wherein the first metal strap extends essentially in a first vertical plane while the second metal strap extends in said first vertical plane and a second vertical plane.

5. The antenna as claimed in claim 4, wherein said first vertical plane is perpendicular to said second vertical plane.

6. The antenna as claimed in claim 4, further including a third L-shaped metal strap connected to a portion of an edge of said first metal strap with a second slot therebetween along other portions of the edge, and also with a third slot between the second strap and the third strap.

7. The antenna as claimed in claim 6, wherein said second slot extends horizontally while the third slot extends vertically.

8. The antenna as claimed in claim 6, wherein said third strap extends in a third vertical plane.

9. The antenna as claimed in claim 8, wherein said first, second and third vertical planes are perpendicular to one another.

10. An ultra wideband antenna comprising:

a ground element comprising an upper first side;

a first metal sheet connected to the first side of the grounding element and a long arm separated from the first side defining a slot with respect to the first side of the ground element;

a second metal sheet electrically connected to the first metal sheet; and a third metal sheet perpendicular to the first and second metal sheet;

wherein said slot, said second metal sheet and said third metal sheet work together to form an ultra broad resonant frequency; wherein the grounding element defines a U-shaped cross-sectional configuration having two spaced horizontal plates, and the third metal sheet is parallel to said two spaced horizontal plates.

11. The ultra wideband antenna as claimed in claim 10, wherein the first metal sheet, the third metal sheet and the grounding element commonly define an S-like configuration in a side view, and the first metal sheet and the third metal sheet occupy an upper half of said S-like configuration.

* * * * *